US009493289B2

(12) United States Patent
Habibi-Naini

(10) Patent No.: US 9,493,289 B2
(45) Date of Patent: Nov. 15, 2016

(54) SELF-SUPPORTING CARTRIDGE, DISPENSING APPARATUS FOR SUCH AS WELL AS METHOD FOR USING THE CARTRIDGE

(75) Inventor: Sasan Habibi-Naini, Rikon (CH)

(73) Assignee: SULZER MIXPAC AG (CH)

( * ) Notice: Subject to any disclaimer, the term of this patent is extended or adjusted under 35 U.S.C. 154(b) by 28 days.

(21) Appl. No.: 13/640,383

(22) PCT Filed: Apr. 6, 2011

(86) PCT No.: PCT/EP2011/055332

§ 371 (c)(1),
(2), (4) Date: Oct. 10, 2012

(87) PCT Pub. No.: WO2011/131483

PCT Pub. Date: Oct. 27, 2011

(65) Prior Publication Data

US 2013/0026182 A1 Jan. 31, 2013

(30) Foreign Application Priority Data

Apr. 19, 2010 (EP) ..... 10160343

(51) Int. Cl.
*B65D 35/22* (2006.01)
*B65D 83/00* (2006.01)
(Continued)

(52) U.S. Cl.
CPC ..... *B65D 83/0072* (2013.01); *B05C 17/00509* (2013.01); *B05C 17/00553* (2013.01); *B05C 17/00583* (2013.01); *B65D 1/26* (2013.01)

(58) Field of Classification Search
CPC ..... B65D 83/0072; B65D 1/26; B05C 17/00553; B05C 17/00583; B05C 17/00509
(Continued)

(56) References Cited

U.S. PATENT DOCUMENTS 3,347,411 A * 10/1967 Kalata ..... B65D 1/26 206/519
3,978,232 A * 8/1976 Dodsworth ..... B65D 1/26 215/376
(Continued)

FOREIGN PATENT DOCUMENTS

DE 694 15 310 T2 4/1999
DE 100 58 672 A1 6/2002
(Continued)

OTHER PUBLICATIONS

International Search Report and Written Opinion for International Patent Application No. PCT/EP2011-055332 mailed on May 31, 2011.
(Continued)

*Primary Examiner* — Patrick M Buechner
*Assistant Examiner* — Jeremy W Carroll
(74) *Attorney, Agent, or Firm* — Global IP Counselors, LLP

(57) ABSTRACT

A self-supporting cartridge is proposed having at least one reception chamber for a medium to be dispensed extending in a longitudinal direction, having a cartridge base and having a cartridge wall all of which define the reception chamber, wherein the cartridge is made by a thermoforming process or by a blow molding process and the cartridge is adapted to be collapsible in a controlled manner. Further a dispensing apparatus for at least one cartridge in accordance with the invention is provided having a support cartridge for the reception of at least one cartridge having a closure device provided at a first axial end of the support cartridge as well as a dispensing plunger provided at the second axial end of the support cartridge for the controlled collapse of the at least one cartridge.

19 Claims, 7 Drawing Sheets

(51) Int. Cl.
*B05C 17/005* (2006.01)
*B65D 1/26* (2006.01)

(58) Field of Classification Search
USPC ..... 222/137, 135, 145.6, 145.5, 145.1, 222/325–327, 94
See application file for complete search history.

(56) References Cited

U.S. PATENT DOCUMENTS

| | | | | |
|---|---|---|---|---|
| 4,801,046 | A * | 1/1989 | Miczka | 222/95 |
| 5,348,392 | A * | 9/1994 | Bouquet et al. | 366/162.3 |
| 5,667,102 | A * | 9/1997 | Keller | 222/95 |
| 6,216,915 | B1 * | 4/2001 | Harman et al. | 222/94 |
| 6,250,505 | B1 * | 6/2001 | Petit | 222/95 |
| 7,306,129 | B2 * | 12/2007 | Swiss et al. | 222/494 |
| 2002/0119221 | A1 * | 8/2002 | Matsukura et al. | 426/115 |
| 2003/0089736 | A1 * | 5/2003 | Ichikawa et al. | 222/105 |
| 2011/0198370 | A1 * | 8/2011 | Ho et al. | 222/137 |
| 2014/0008391 | A1 * | 1/2014 | Lin | 222/136 |

FOREIGN PATENT DOCUMENTS

| | | | |
|---|---|---|---|
| DE | 10 2004 056 908 | A1 | 6/2006 |
| EP | 1 284 163 | A1 | 2/2003 |
| GB | 1 118 419 | | 7/1968 |
| MY | 142211 | A | 11/2010 |
| WO | 2009/033053 | A1 | 3/2009 |

OTHER PUBLICATIONS

International Search Report for International Patent Application No. PCT/EP2011/055332 mailed on May 31, 2011.

* cited by examiner

SELF-SUPPORTING CARTRIDGE, DISPENSING APPARATUS FOR SUCH AS WELL AS METHOD FOR USING THE CARTRIDGE

PRIORITY CLAIM

The present application is a National Stage of International Application No. PCT/EP2011/055332, filed on Apr. 6, 2011, which claims priority to European Patent Application No. 10160343.9 filed on Apr. 19, 2010, the entire contents of which are being incorporated herein by reference.

BACKGROUND

The invention relates to a self-supporting cartridge having at least one reception chamber for a medium to be dispensed extending in a longitudinal direction, further to a dispensing apparatus for such a cartridge, as well as to a method for use of such a cartridge.

In the industrial domain, in the construction trade, for example of buildings, and also in the dental field cartridges are frequently used to store flowable substances and, on demand, to dispense these for the respective application. Examples of such substances are joint sealing compounds, compounds for chemical dowels or chemical stays, adhesives, pastes or impression material in the field of dentistry. Typically these cartridges are made from plastic and are produced in an injection mold process.

One differentiates between a one component system in which the material to be dispensed is only made of a single component, and a two or more component system in which at least two different components are stored in separate chambers of the same cartridge or are stored in separate cartridges, with the components being thoroughly mixed on dispensing by means of a dynamic mixing apparatus or of a static mixing apparatus. An example for this are two-component adhesives which only harden following the mixing of the two-components.

It is typical that the cartridges have an axially displaceable dispensing piston through whose movement the material is dispensed from the chamber or the chambers. It is naturally understood that the chambers must have a sufficient wall thickness so that they can withstand the resultant pressure on dispensing. Since such plastic cartridges are generally only designed for a single use, a significant amount of waste results both from the volume and also from the dimensions which is also particularly detrimental under the aspect of environmental protection.

A known alternative for plastic cartridges is represented by hoses in which the respective material is stored. These hoses are then inserted into special support apparatuses or dispensing apparatuses to dispense their contents for the respective application. In particular, from the point of view of the waste volumes such hoses are significantly more favorable than cartridges; however, they have other disadvantages. Significantly more complex filling apparatuses are required to fill the hoses and to close these. Moreover, their storage is more problematic as, on the one hand, the hoses are not self-supporting and, on the other hand, the hoses are significantly more sensitive than the cartridges so that particular measures and/or packages have to be provided for their storage.

SUMMARY

Based on this prior art it is therefore an object of the invention to provide a self-supporting cartridge which is environmentally friendly in particular with regard to its waste volume and to its amount of waste. Further, a dispensing apparatus for such a cartridge will be provided by the invention. Moreover, the invention should also provide a method for the use of such an apparatus.

The subject matters satisfying this object of the invention are characterized by the features of the independent claim of the respective category.

Thus, in accordance with the invention a self-supporting cartridge is provided having at least one reception chamber for a medium to be dispensed extending in a longitudinal direction, having a cartridge base and having a cartridge wall all of which define the reception chamber, wherein the cartridge is made by a thermoforming process or by a blow molding process and the cartridge is adapted to be collapsible in a controlled manner.

Since the self-supporting cartridge in accordance with the invention is adapted to be collapsible in a controlled manner the waste volume of the emptied cartridges can be significantly reduced, despite their selfsupporting nature, in comparison to known cartridges. The use of a thermoforming process or a blow molding process for the production of a cartridge in accordance with the invention allows, in particular a more thin-walled design of the cartridge than, e.g. in an injection mold process in which the ratio of the flow path to the wall thickness cannot exceed a predetermined value in practice without extra measures being required which are particularly demanding in cost and time. Due to the possibility of a thin-walled design a significant reduction in the amount of waste results.

Preferably the cartridge is made by a stretch blow molding process or by an extrusion blow molding process or by thermoforming.

For the collapsible design of the cartridge it is a particularly preferable measure when the cartridge wall has predetermined breaking points for the controlled collapse of the cartridge.

It is particularly advantageous in view of the collapsing and of the reduction of the amount of waste when the cartridge has a wall thickness of at most 2 mm, preferably of at most 1.5 mm and especially preferably of at most 1 mm.

In an embodiment the cartridge or each reception chamber is configured cylindrically which, in particular is advantageously realized using the blow molding process.

For a different embodiment the cartridge or each reception chamber is tapered with regard to the longitudinal direction. This embodiment is particularly favorably produced by means of thermoforming.

The cartridge can also have two reception chambers which are arranged adjacent to one another with regard to the longitudinal direction.

In accordance with the invention a dispensing apparatus for at least one cartridge in accordance with the invention is further provided having a support cartridge for the reception of at least one cartridge having a closure device provided at its first axial end as well as a dispensing plunger provided at the second axial end of the support cartridge for the controlled collapse of the at least one cartridge.

Preferably the closure device includes a dispensing element which is detachably connected to the closure device or is inseparably formed at the closure device. In the case of a one component system this dispensing element is preferably shaped as a nozzle, in the case of a two-component or multi-component system it is formed as a static mixing element or a dynamic mixing element. When the dispensing element is formed from one piece with the closure device, i.e. inseparable from this, the closure device is typically formed as a disposable part for the one-time use. If the dispensing element is detachably connected to the closure device then typically only the dispensing element is intended for the one-time use while the rest of the closure device is usable a plurality of times.

For two or more mixing components the dispensing element is preferably configured as a static mixer.

In a preferred embodiment the closure device is hinged at the support cartridge. This is particularly advantageous for the handling properties.

A movable piston can be provided in the support cartridge which, on the one hand cooperates with the dispensing plunger and, on the other hand, acts on the cartridge base for the controlled collapse. Alternatively, it is naturally also possible that the dispensing plunger acts directly on the cartridge base without a piston being provided therebetween. For this embodiment the support cartridge can have two chambers arranged adjacent to one another with regard to the longitudinal axis which each receive a separate cartridge or each receive a reception chamber of the same cartridge.

Further a method for use of such a cartridge is provided by the invention, the method having the following steps:

- production of a cartridge in accordance with the invention
- filling of the reception chamber with a medium to be dispensed
- closing the reception chamber
- insertion of a cartridge into the support cartridge of a dispensing apparatus in accordance with the invention
- closing the support cartridge with the closure device
- dispensing of the medium to be dispensed by collapsing the cartridge with the aid of the dispensing plunger.

Further advantages, features and details of the invention result with reference to the following description of embodiments and with reference to drawings in which elements which are the same or have the same function are provided with identical reference numerals.

Additional features and advantages are described herein, and will be apparent from the following Detailed Description and the figures.

BRIEF DESCRIPTION OF THE FIGURES

In the following the invention will be described in detail with reference to embodiments and the drawing. In the schematic drawing there are shown partially in section.

DETAILED DESCRIPTION

Figure 1:
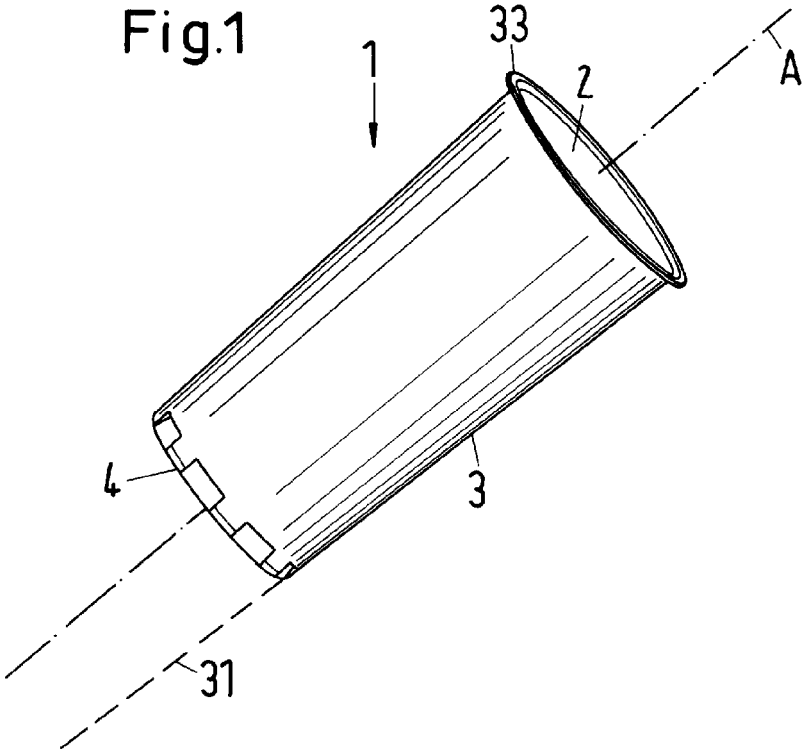
FIG. 1 a first embodiment of a cartridge in accordance with the invention in a perspective view, FIG. 2 a plurality of cartridges from FIG. 1 in stacked form, FIG. 3-6 variants of the design of the cartridge wall, FIG. 7 a variant for the cartridge base and/or the cartridge wall, FIG. 8 a first embodiment of a dispensing apparatus in accordance with the invention in a sectional illustration.

In a perspective illustration FIG. 1 shows a first embodiment of a cartridge in accordance with the invention which is referred to in its entirety by the reference numeral 1. The cartridge 1 here includes a reception chamber 2 for a medium to be dispensed extending in the longitudinal direction. The longitudinal direction is determined by the longitudinal axis of the cartridge 1 which is referred to by A. The reception chamber is defined by a cartridge wall 3 as well as a cartridge base 4. This cartridge base 4 is not displaceable relative to the cartridge wall 3, i.e. it is especially not configured as a dispensing piston. At the axial end of the cartridge wall 3 remote from the cartridge base 4, a collar 33 is provided which is intended for the cooperation with a cover or a closure film (not illustrated in FIG. 1).

In this respect the term "self-supporting cartridge" means that the cartridge can be placed both in an empty state and also in a filled state onto the cartridge base 4, without the cartridge 1 thereby changing its outer shape due to gravity, as would for example be the case for a hose.

In the first embodiment the cartridge is adapted such that it tapers towards the cartridge base 4 with regard to the longitudinal direction. This can be recognized in FIG. 1 in that the auxiliary line 31, which forms the extension of the cartridge wall 3 is tilted with respect to the longitudinal axis 3. Naturally, it is also possible that the cartridge 1 can be configured cylindrically as is shown with reference to the third embodiment.

Figure 2:
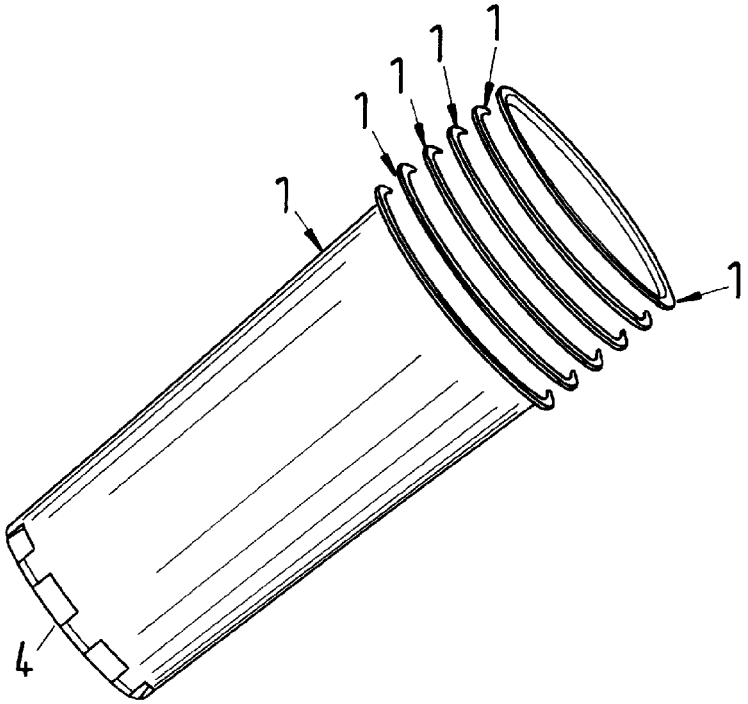

The tapered embodiment shown in FIG. 1 has the advantage that the still unfilled cartridges 1 can be stacked into one another as is shown in FIG. 2. Thus, significant space can be saved on storage of the unfilled cartridges 1 or on transport thereof to the filler.

In accordance with the invention the self-supporting cartridge 1 is made by a thermoforming process or a blow molding process. For the tapered embodiment of the cartridge in accordance with FIG. 1 thermoforming is particularly preferred. For a cylindrical embodiment of the cartridge stretch blow molding processes or extrusion flow molding processes are particularly preferred. The thermoforming process and the blow molding process such as the stretch blow molding process or the extrusion blow molding process are well known to the person of ordinary skill in the art and therefore do not require a detailed description.

In accordance with the invention the cartridge 1 is adapted such that it is collapsible in a controlled manner. This means the cartridge 1 is pressed in the direction of the longitudinal axis on the application of pressure onto the cartridge base 4 in a controlled manner, without significant prohoserances occurring in the radial direction perpendicular to the longitudinal axis A, this means that the diameter of the cartridge 1 essentially remains unchanged on collapsing. The cartridge can be pushed together in the direction of the longitudinal direction in an accordion fashion or in a similar way.

To enable this controlled collapse several measures—also in combination with one another—are possible. For example, the cartridge 1 can be designed having such a thin cartridge wall 3 that the cartridge 1, on the one hand, is still self-supporting and, on the other hand, is controllable. In practice wall thicknesses d of the cartridge wall 3 (see FIG. 3) of at most 3 mm, preferably of at most 1.5 mm and in particular most preferably of at most 1 mm have been tried and tested.

Figure 3:
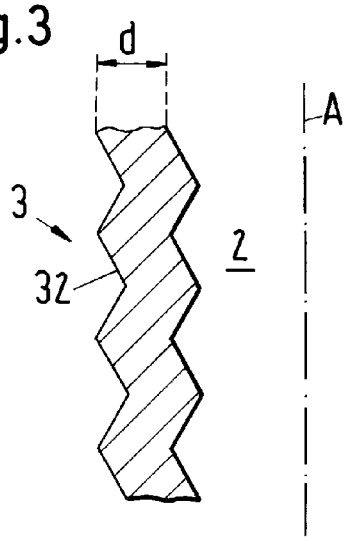
Figure 5:
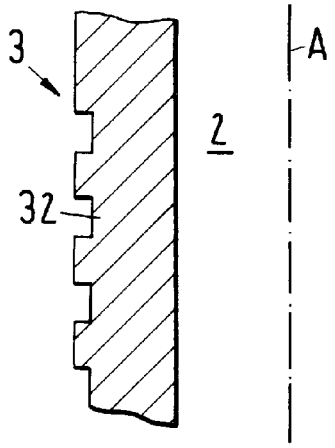
Figure 4:
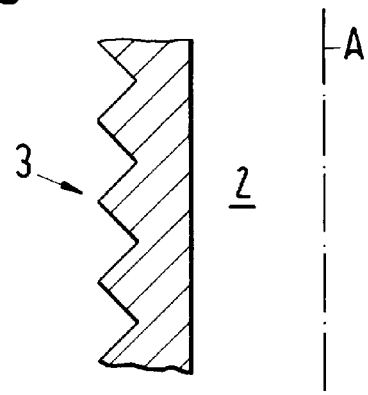
Figure 6:
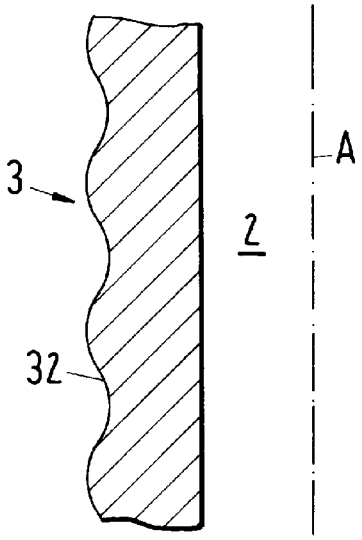

Further alternatives or additional measures for the collapsible design of the cartridge 1 are illustrated in FIGS. 4-6. In these predetermined breaking points 32 are respectively provided, to ease the controlled collapse. FIG. 3 shows a bellow-shaped and/or a folded bellow-shaped embodiment of the cartridge wall 3. For the variant in accordance with FIG. 4 the outer side of the cartridge wall 3 is formed zigzag-shaped. For the variant in accordance with FIG. 5 several grooves 32 are provided as predetermined breaking points which each extend in the circumferential direction of the cartridge wall 3, with the grooves respectively not having to extend over the entire circumference. For the variant shown in FIG. 6 the cartridge wall 1 is formed wave-shaped.

The cartridge consists of plastic, with all types of plastics typically used for the production of cartridges also being suitable for the production of a cartridge 1 in accordance with the invention, for example polyamides (PA), polypropylene (PP), polyethylene (PE), polyolefin in general; also ethylene copolymers such as EVOH, can be provided as barrier layers or as blocking layers.

Figure 7:
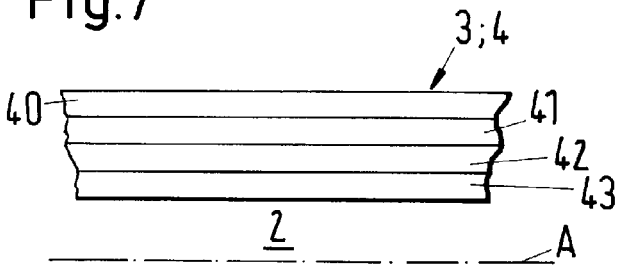

A particularly preferred measure is to design the cartridge wall 3 and/or the cartridge base 4 as a multi-layer system, such as e.g. from several films or layers placed on top of one another. Such an example is shown in FIG. 7. A first layer 43 which serves as a protective layer and consists of an insensitive plastic with regard to the medium to be dispensed is arranged facing the reception chamber 2, said plastic being, for example, polyamide (PA) or poly butylene terephthalate (PET). Optionally a barrier layer 42 can be attached thereto which prevents the escape and/or reception of substances, such as a water, oxygen or VOC (volatile organic compounds). This is followed by a filling layer 41 which consists e.g. of recyclate. Finally a substrate layer follows on the outside which typically consists of a polyolefin, such as PE or PP.

Naturally, also other layers can be provided or the cartridge wall 3 and the cartridge base 4 can consist only of a single layer, such as PP, PA or PBT.

Additionally or alternatively, also foamed films can be provided as a layer.

In the following description of the embodiments of the dispensing apparatus in accordance with the invention, reference is made with exemplary character to a two-component system particularly relevant for practice. Naturally, the explanations also apply accordingly to a one-component system or generally to a multi-component system.

Figure 8:
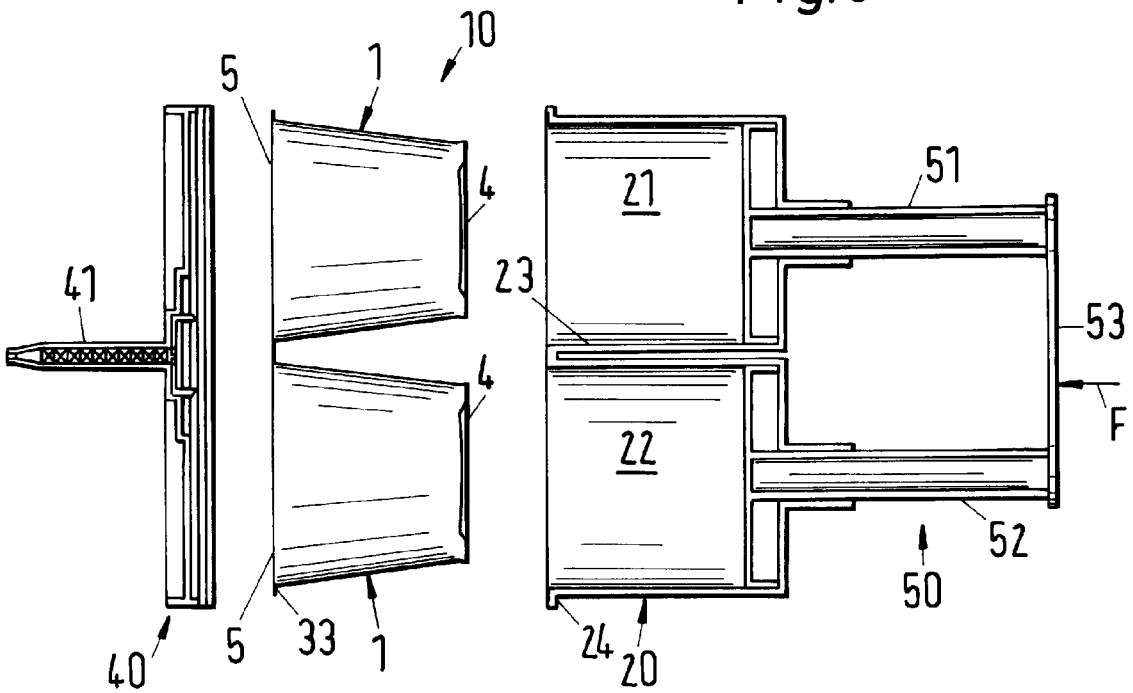

FIG. 8 shows in a sectional illustration a first embodiment of a dispensing apparatus in accordance with the invention which is referred to in its entirety by the reference numeral 10 and also shows two cartridges 1 which are each configured in accordance with the embodiment illustrated in FIG. 1. The reception chamber 2 of the cartridge 1 are respectively filled with a medium to be dispensed, wherein the first cartridge 1 includes the first component and the other cartridge 1 includes the second component of the two-component system. Following the filling of the reception chambers 2, they are closed by a cover 5 at the end remote from the cartridge base which lies on the edge 33 (FIG. 1) and/or overlaps this. The cover 5 can be adapted e.g. as a film or as a plastic cap and is sealingly connected with the collar 33. The cover 5 protects the medium contained in the reception chamber 2 during storage against dampness, degasing, running dry or any other form of degradation. The connection of the cover 5 to the cartridge wall 3 and/or to the collar 33 can be achieved by adhesive bonding, friction welding, ultrasonic welding, a snap connection or similar methods.

The dispensing apparatus 10 includes a support cartridge 20 for receiving the cartridge 1 as well as a closure device 40 which is provided at a first axial end of the support cartridge 20, and a dispensing plunger 50 which is provided at the second axial end of the support cartridge 20. In the first embodiment of the dispensing apparatus 10 this support cartridge 20 includes two chambers 21, 22 arranged adjacent to one another which are each adapted for the reception of a cartridge 1 and which are separated by a dividing wall 23. At their ends facing the closure device 40 each chamber 21, 22 has a circumferential edge 24.

The closure device 40 includes a dispensing element 41 which in the present case is adapted as a static mixer 41, through which the media coming from the two cartridges 1 are mixed with one another. The static mixer 41 is preferably detachably connected to the closure device 40 as it is typically only suited for a single use. The closure device 40 then represents the interface between the support cartridge 20 and the static mixer 40. Alternatively it is also possible that the static mixer 41 is adapted as a single part with the closure device 40. In this case the complete closure device 40 is typically intended for a one-time use. In the case of a one component system the static mixer 41 can be replaced by a dispensing element adapted as a nozzle.

The dispensing plunger 50 includes two punches 51, 52 arranged in parallel to one another of which the first punch 51 is movably arranged in the axial direction of the first chamber 21, whilst the second punch 52 is arranged movably in the axial direction of the second chamber 22 of the support cartridge 20. The two punches 51 and 52 are typically connected via a connection 53 so that on the application of a force illustrated by the arrow F onto the connection 53 of the dispensing plunger 50 both punches 51 and 52 simultaneously move in axial direction in their associated chambers 21, 22.

Figure 9:
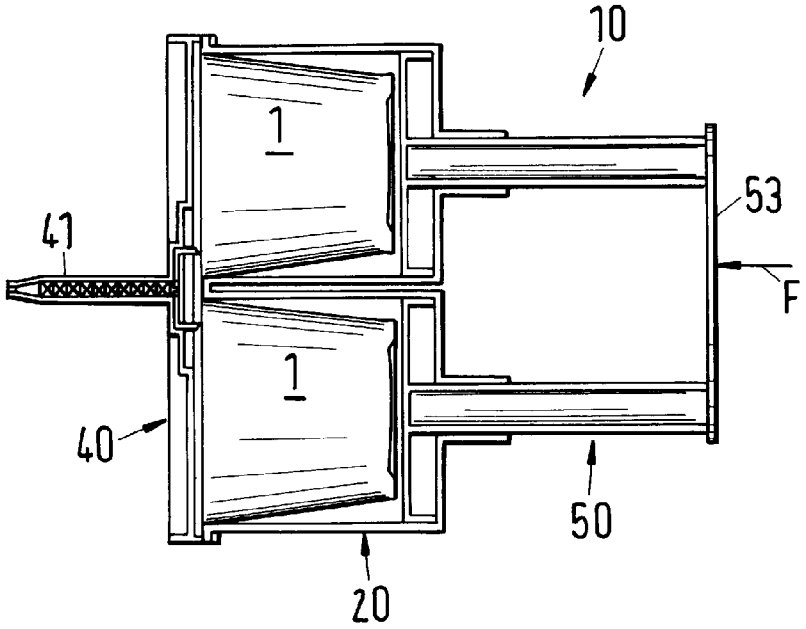
FIG. 9 the embodiment of FIG. 8 having an inserted cartridge.

FIG. 9 shows the first embodiment of the dispensing apparatus 10 with inserted cartridges 1. In each of the two chambers 21 and 22 one of the two cartridges 1 is inserted. In this respect the collar 33 of the cartridge 1 lies on the edge 24 of the chambers 21 and/or 22 of the support cartridge 20. Following this the closure device 40 is set onto the first axial end of the support cartridge 20 and closes this. The closure device 40 includes two opening elements, not illustrated in detail, for example two spikes or two pins, which respectively each pierce the cover 5 of a cartridge 1 on closing of the support cartridge 20 so that the medium can be dispensed from the respective cartridge 1.

The static mixer element 41 is arranged such that its inlet is in flowing connection with the two reception chambers 2 of the two cartridges 1 following the piercing of the cover 5. Here the static mixer element 41 is arranged such that its inlet lies centrally above the dividing wall 23 so that the medium can arrive in the mixer 41 from both sides of the dividing wall 23. Alternatively it is naturally also possible that the static mixer 41 has two separate inlets which are each in connection with the reception chamber 2 of the cartridge 1.

For the dispensing of the medium from the cartridges 1 a force is now applied to the connection 53 of the dispensing plunger 50 as is indicated by the arrow F, whereby the two punches 51, 52 move to the left in accordance with the illustration and each apply a force onto the cartridge wall 4 of the two cartridges 1. Since the cartridges 1 are collapsible in a controlled manner they are pushed together by the punches 51 and 52, whereby the first component is pressed out of the cartridge 1 and the second component is pressed out of the other cartridge 1. In this way the two components arrive in the static mixer 41 where they are thoroughly mixed and finally dispensed at its distal end.

Figure 10:
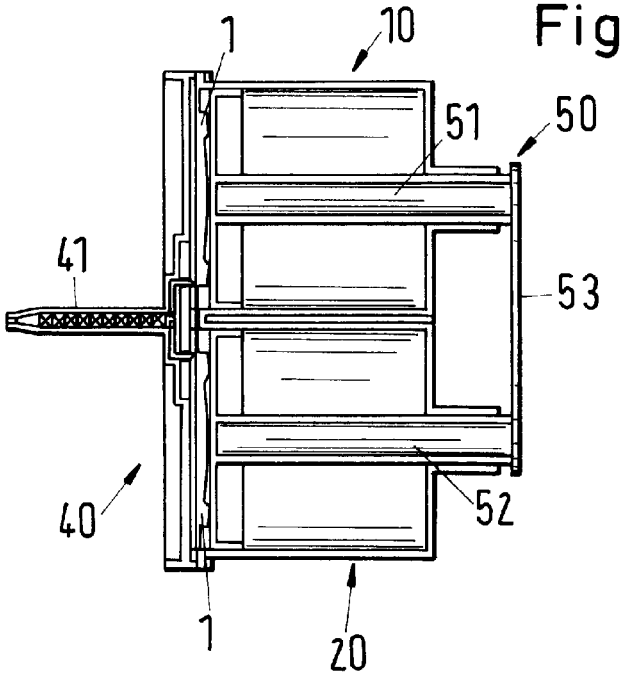
FIG. 10 as FIG. 9; however, having a collapsed cartridge.
Figure 11:
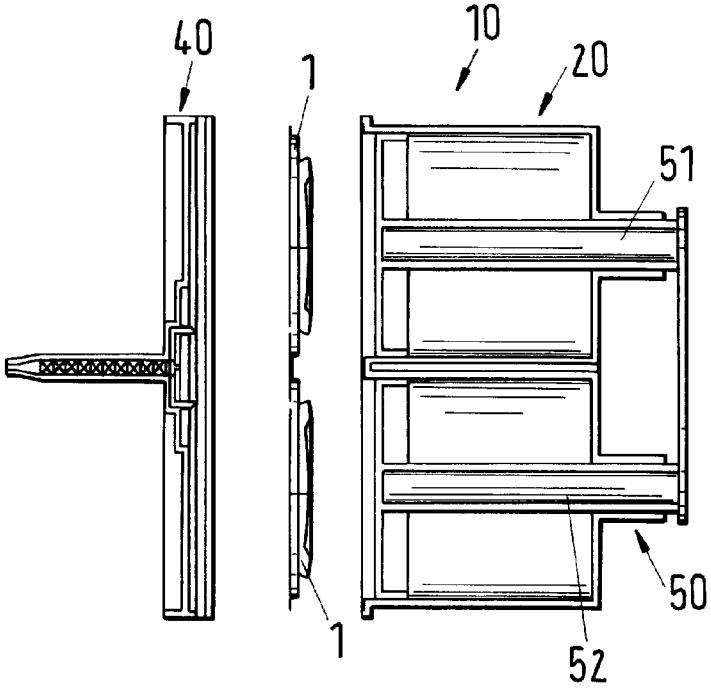
FIG. 11 as FIG. 10; however, on the removal of a collapsed cartridge.

FIG. 10 shows the dispensing apparatus 10 which is completely collapsed, i.e. a completely empty cartridge 1. As is shown in FIG. 11 after emptying of the cartridge 1 the closure device 40 is removed from the support cartridge 20 and the collapsed cartridges 1 can be removed. One can clearly recognize that a significantly reduced waste volume results through the collapsed cartridges 1 compared to conventional cartridges.

Following the removal of the collapsed cartridges 1 both punches 51, 52 of the dispensing plunger 5 are moved to the right in accordance with the illustration so that new filled cartridges 1 can be inserted into the chambers 21, 22 of the support cartridge 20. The static mixer 41 is replaced by a new one. If necessary the closure device 40 still has to be cleaned and/or rinsed before the dispensing apparatus 10 is available for a further application.

Figure 12:
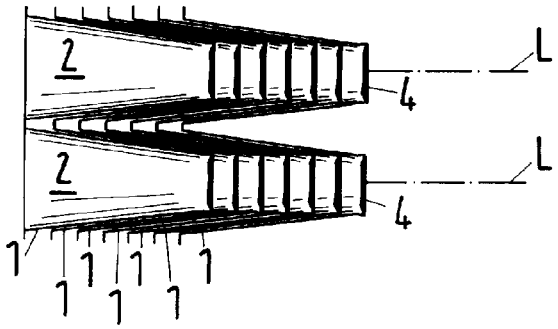
FIG. 12 a second embodiment of the cartridge in accordance with the invention in stacked form, FIG. 13 as FIG. 8; however, for a second embodiment of a dispensing apparatus in accordance with the invention, FIG. 14 the embodiment of FIG. 13 having an inserted cartridge, FIG. 15 as FIG. 14; however, on removal of the cartridge, FIG. 16 a third embodiment of a dispensing apparatus in accordance with the invention having a third embodiment of the cartridge in accordance with the invention, FIG. 17 as FIG. 16; however, having inserted cartridge, FIG. 18 as FIG. 17; however, having collapsed cartridge, FIG. 19 as FIG. 18; however, on removal of the collapsed cartridge, and FIG. 20 a variant for the dispensing device in accordance with the invention.

FIG. 12 shows a second embodiment of a cartridge 1 in accordance with the invention, wherein several cartridges are stacked into one another (comparable to FIG. 2). In the following the differences to the first embodiment will be closely described. Otherwise the explanations given for the first embodiment also apply accordingly to the second embodiment.

In the second embodiment (see also FIG. 13) the cartridge 1 includes two reception chambers 2 which are arranged adjacent to one another with regard to the longitudinal direction L and are each tapered towards the cartridge base 4. Each of the two reception chambers 2 includes one of the two component of the two component system after their filling.

Figure 13:
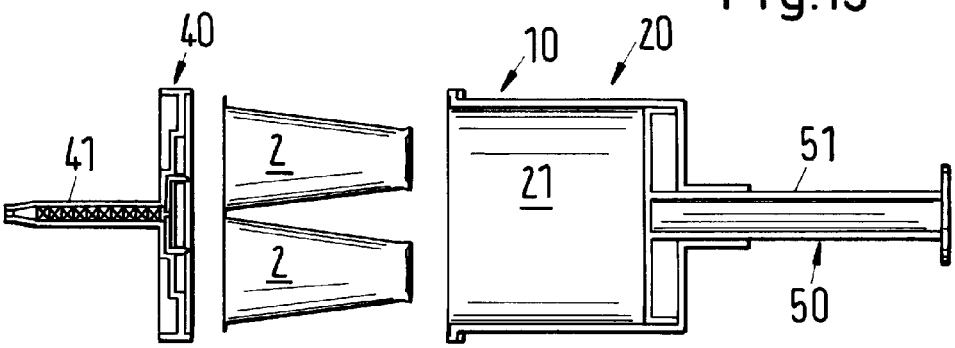

FIG. 13 shows a second embodiment of a dispensing apparatus 10 in accordance with the invention, in an illustration analogous to FIG. 8. In this embodiment the support cartridge 20 only has one chamber 21 which receives both reception chambers 2 of the cartridge 1. Accordingly the dispensing plunger 50 only has one punch 51 which collapses the two reception chambers 2 of the cartridge 1 on dispensing of the material.

Figure 14:
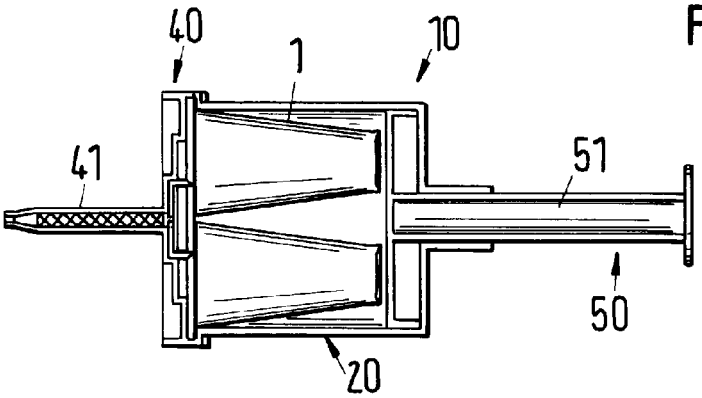
Figure 15:
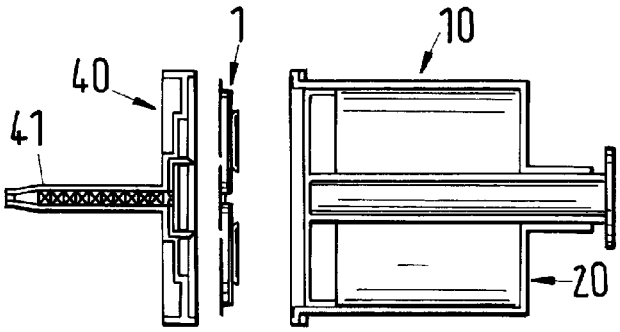

FIG. 14 shows the dispensing apparatus 10 with an inserted cartridge 1, in an illustration analogous to FIG. 9. In an illustration analogous to FIG. 11, FIG. 15 shows how the cartridge 1 is removed from the dispensing apparatus 10 following the complete collapse by the plunger 51.

The FIGS. 16-19 show a third embodiment of the dispensing apparatus 10 in accordance with the invention having a third embodiment of the cartridge 1 in accordance with the invention. Again only the differences to the previously described embodiments are discussed in detail. The explanations given so far also apply accordingly to the third embodiment of the dispensing apparatus 10 in accordance with the invention and for the cartridge 1. In this embodiment the cartridge 1 includes two reception chambers 2 which are each configured cylindrically. The support cartridge of the dispensing apparatus 10 includes a chamber 21 which receives both reception chambers 2 of the cartridge 1. Correspondingly the dispensing plunger 50 also includes only one plunger 51 for collapsing the cartridge 1. The closure device 40 having the static mixer 41 is hinged at the support cartridge 20 in this embodiment. This can be any type of hinged connection, for example also an integral hinge.

Figure 16:
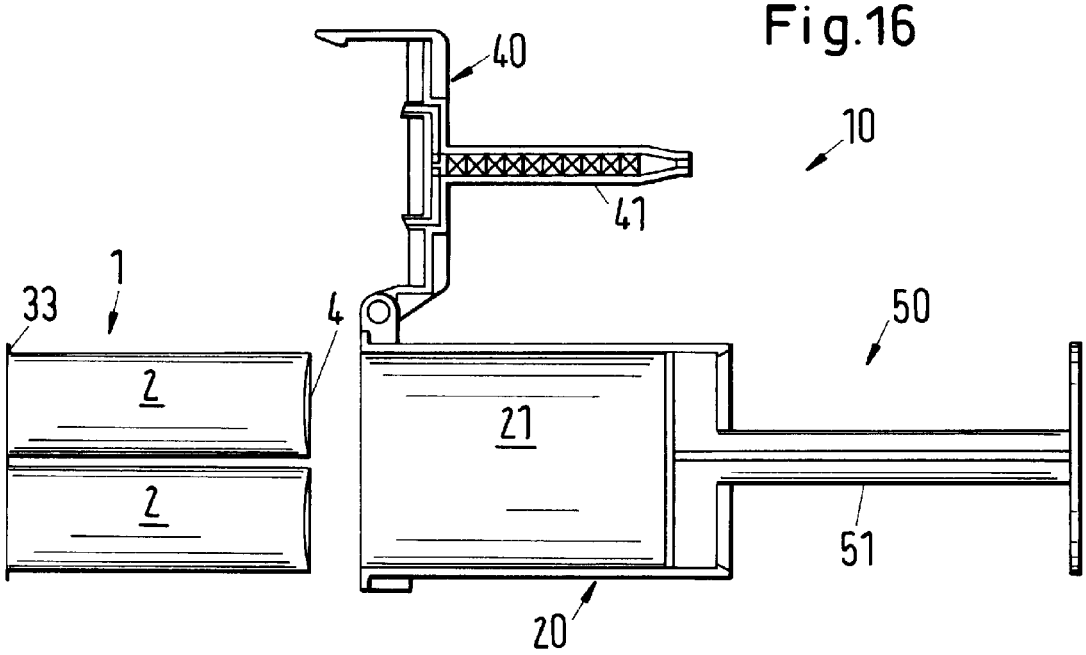
Figure 17:
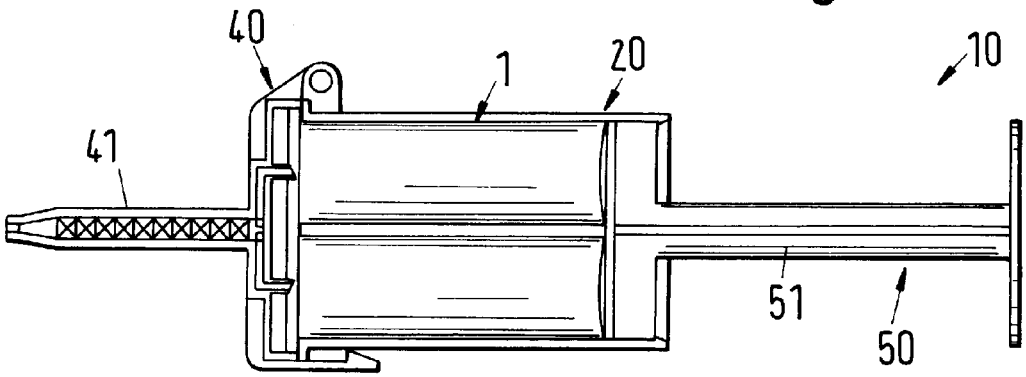
Figure 18:
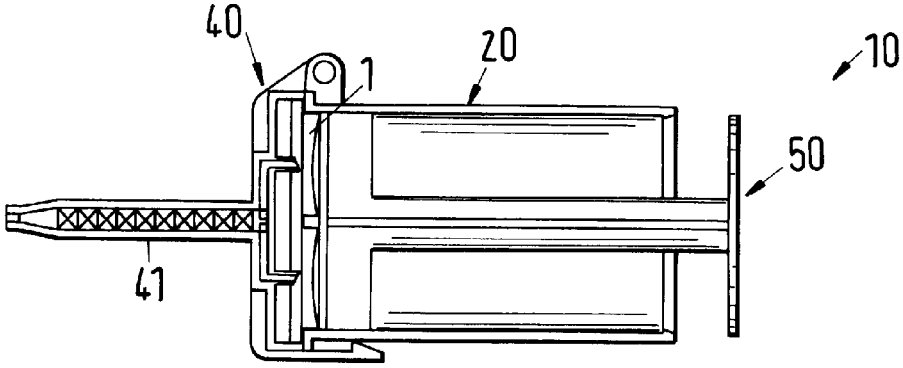
Figure 19:
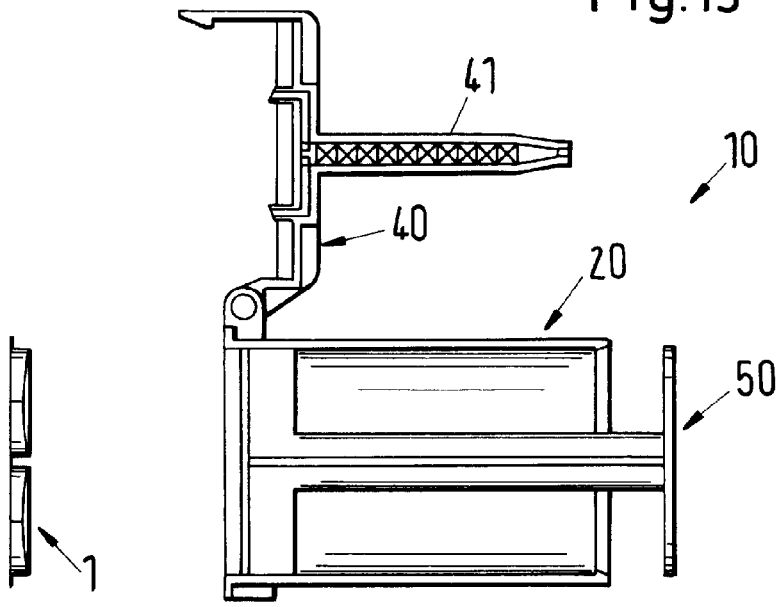

FIG. 16 shows the dispensing apparatus 10 before the insertion of the cartridge 1, FIG. 17 shows the dispensing apparatus 10 with an inserted cartridge 1 and in the closed state. FIG. 18 shows the dispensing apparatus 10 with a completely collapsed cartridge 1 and FIG. 19 shows there-opened dispensing apparatus 10 from which the collapsed cartridge 1 can be removed.

Figure 20:
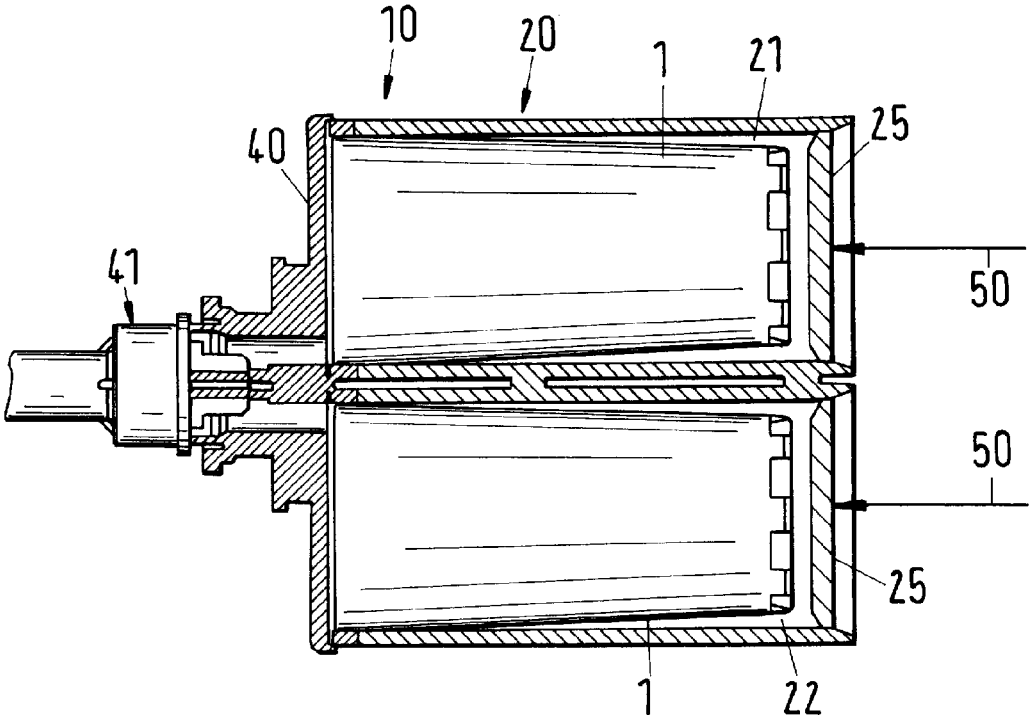

FIG. 20 shows a variant for the dispensing apparatus 10 in which a movable piston 25 is provided in the support cartridge 20 which, on the one hand, cooperates with the dispensing plunger 50 as is indicated by the arrow in FIG. 20 and, on the other hand, acts on the cartridge base 4 for the controlled collapse. The support cartridge 20 includes two chambers 21, 22 which are separated from one another by the dividing wall 23. In each of the chambers 21, 22 a cartridge 1 is inserted and each of the chambers 21, 22 is provided with a piston 25 at its end facing the dispensing plunger. When the dispensing plunger 50 is moved to the left in accordance with the illustration then the two pistons 25 also move to the left whereby the two cartridges 1 are collapsed.

The measures and variants described for the individual embodiments of the self-supporting cartridge in accordance with the invention and/or the dispensing apparatus in accordance with the invention can naturally also be realized in an analogous manner or a correspondingly similar way also for the other embodiments and are in no way restricted to the single embodiment in accordance with which it was described.

The cartridge 1 in accordance with the invention and/or the dispensing apparatus 10 in accordance with the invention can be advantageously used as follows: First a cartridge in accordance with the invention is produced and delivered to the filler. In particular with the tapered design of the cartridge 1 or of the reception chamber 2 a considerable amount of space can be saved in this respect, as the cartridges 1 can be stacked into one another. The filler then fills the respective medium into the reception chamber(s) 2 of the cartridge 1 and closes them with the cover 5. Since the cartridge in accordance with the invention is self-supporting, this can be stored particularly easily and also be stacked without particular protective measures being necessary. For the respective application the cartridge 1 and/or the cartridges 1 are inserted into reusable support cartridges 20 of the dispensing apparatus 10. The support cartridge 20 is then closed by means of the closure device 40. In this respect or subsequently all reception chambers are opened and/or activated so that the respective contents can be dispensed from them. This can, e.g. be achieved using suitably arranged spikes which pierce into the cover and/or the sealing film of the reception chambers. Naturally, it is also possible to remove the cover 5 and/or the films with which the reception chambers are closed before or after the insertion of the cartridge(s) 1 by hand. The medium to be dispensed is finally dispensed through the collapse of the cartridge(s) 1 by means of the dispensing plunger 50.

The self-supporting collapsible cartridge 1 in accordance with the invention is characterized in particular by a significantly reduced amount of waste in comparison to other cartridges.

The invention claimed is:

1. A self-supporting cartridge comprising:

a circular cartridge base;

a cartridge wall integrally formed with the cartridge base such that the cartridge wall and cartridge base are a one-piece member;

a cartridge opening disposed at an end of the cartridge opposite the cartridge base, the cartridge opening extending over an entire cross-sectional area of the cartridge; and at least one reception chamber configured to dispense a medium through the cartridge opening, the reception chamber being defined by the cartridge base and the cartridge wall and extending in a longitudinal direction, the at least one reception chamber including two reception chambers arranged adjacent to one another with respect to the longitudinal direction;

the cartridge being constructed by a thermoforming process or by a blow molding process.

2. The cartridge in accordance with claim 1, wherein the cartridge wall has one of a zigzag shape, a wave shape, and a shape including grooves so as to be collapsible in a controlled manner.

3. The cartridge in accordance with claim 1, wherein the cartridge has a wall thickness less than or equal to 2 mm.

4. The cartridge in accordance with claim 3, wherein the wall thickness of the cartridge is less than or equal to 1 mm.

5. The cartridge in accordance with claim 3, wherein the wall thickness of cartridge is less than or equal to 1.5 mm.

6. The cartridge in accordance with claim 1, wherein the cartridge has a wall thickness less than or equal to 3 mm.

7. The cartridge in accordance with claim 1, wherein the cartridge has a diameter configured to remain substantially constant when the cartridge is in a collapsed state.

8. The cartridge in accordance with claim 1, wherein one of the cartridge and each of the reception chambers has a cylindrical structure.

9. The cartridge in accordance with claim 1, wherein one of the cartridge and each of the reception chambers is tapered in a longitudinal direction.

10. The cartridge in accordance with claim 1, wherein the cartridge wall is defined by an inner wall and an outer wall, the inner wall having a first zigzag shape including a plurality of first inversion points, the outer wall having a second zigzag shape including a plurality of second inversion points, the first and second inversion points being aligned with respect to each other.

11. The cartridge in accordance with claim 1, wherein the cartridge wall is defined by an inner wall and an outer wall, the outer wall having a first shape that is one of a zigzag shape, a wave shape and a shape including grooves, the inner wall having a second shape that is a substantially flat surface.

12. The cartridge wall in accordance with claim 1, wherein the cartridge wall is defined by a plurality of layers, each of the layers having a longitudinal length that is parallel with the longitudinal direction of the reception chamber.

13. A dispensing apparatus comprising:

a support cartridge; and at least one cartridge, the support cartridge being configured to receive the at least one cartridge and having a closure device provided at a first axial end and a dispensing plunger provided at a second axial end, the cartridge comprising a circular cartridge base, a cartridge wall integrally formed with the cartridge base such that the cartridge wall and the cartridge base are a one-piece member, a cartridge opening disposed at an end of the cartridge opposite the cartridge base, the cartridge opening extending over an entire cross-sectional area of the cartridge, and at least one reception chamber configured to dispense a medium through the cartridge opening, the reception chamber being defined by the cartridge base and the cartridge wall and extending in a longitudinal direction, the cartridge being constructed by a thermoforming process or by a blow molding process.

14. The dispensing apparatus in accordance with claim 13, wherein the closure device includes a dispensing element detachably connected to the closure device or inseparably formed with the closure device.

15. The dispensing apparatus in accordance with claim 14, wherein the dispensing element is a static mixer.

16. The dispensing apparatus in accordance with claim 13, wherein the closure device is hinged at the support cartridge.

17. The dispensing apparatus in accordance with claim 13, wherein the support cartridge includes a moveable piston configured to engage the dispensing plunger and act on the cartridge base to collapse the cartridge in the controlled manner.

18. The dispensing apparatus in accordance with claim 13, wherein the support cartridge includes two chambers arranged adjacent one another with respect to the longitudinal direction, each of the chambers of the support cartridge receiving a cartridge or each of the chambers of the support cartridge receiving a reception chamber of a same cartridge.

19. A method for using a cartridge comprising:

constructing a cartridge by a thermoforming process or a blow molding process such that the cartridge is collapsible in a controlled manner, the cartridge comprising a circular cartridge base, a cartridge wall integrally formed with the cartridge base such that the cartridge wall and the cartridge base are a one-piece member, a cartridge opening disposed at an end of the cartridge opposite the cartridge base and extending over an entire cross-sectional area of the cartridge, and at least one reception chamber for dispensing a dispensable medium through the cartridge opening, the reception chamber being defined by the cartridge base and the cartridge wall and extending in a longitudinal direction, filling the reception chamber with the dispensable medium;

closing the reception chamber;

inserting the cartridge into a support cartridge of a dispensing apparatus, the support cartridge having a closure device provided at a first axial end and a dispensing plunger provided at a second axial end, the support cartridge being configured to enable a controlled collapse of the cartridge;

closing the support cartridge with the closure device; and collapsing the cartridge in the controlled manner with aid of the dispensing plunger to dispense the dispensable medium.

* * * * *